US007084585B2

(12) United States Patent
Yamamoto et al.

(10) Patent No.: US 7,084,585 B2
(45) Date of Patent: Aug. 1, 2006

(54) DISCHARGE LAMP LIGHTING APPARATUS

(75) Inventors: Noboru Yamamoto, Kariya (JP); Yukio Kunieda, Nagoya (JP); Tomoyuki Funayama, Toyota (JP)

(73) Assignees: Denso Corporation, Kariya (JP); Toyota Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 10/921,362

(22) Filed: Aug. 19, 2004

(65) Prior Publication Data

US 2005/0057192 A1 Mar. 17, 2005

(30) Foreign Application Priority Data

Aug. 21, 2003 (JP) ..... 2003-297451
Jul. 15, 2004 (JP) ..... 2004-209043

(51) Int. Cl.
*H05B 37/02* (2006.01)

(52) U.S. Cl. ..... 315/291; 315/308; 315/DIG. 7

(58) Field of Classification Search ..... 315/224–226, 315/291, 307–308, DIG. 5, DIG. 7
See application file for complete search history.

(56) References Cited

U.S. PATENT DOCUMENTS 5,365,152 A * 11/1994 Ozawa et al. ..... 315/291
5,465,029 A 11/1995 Hanazaki et al. ..... 315/308
5,485,061 A * 1/1996 Ukita et al. ..... 315/307
5,751,121 A * 5/1998 Toyama et al. ..... 315/307
2002/0070687 A1 6/2002 Urakabe et al. ..... 315/291

FOREIGN PATENT DOCUMENTS

EP 0 746 186 5/1996
JP 8-321389 12/1996
JP 10-321388 12/1998

* cited by examiner

*Primary Examiner*—Thuy Vinh Tran
(74) *Attorney, Agent, or Firm*—Posz Law Group, PLC

(57) ABSTRACT

The discharge lamp lighting apparatus includes a high-voltage generating coil connected in series to a discharge lamp for applying a high voltage to the discharge lamp to turn on the lamp, an inverter for inverting a dc voltage into an ac voltage in order to supply a lamp current to the discharge lamp on an alternating basis through the high voltage generating coil, a lamp voltage detecting circuit for detecting a voltage across the discharge lamp as a lamp voltage, and a lamp power control circuit for controlling an ac power supplied to the discharge lamp from the inverter on the basis of the lamp voltage detected by the lamp voltage detecting circuit. The lamp voltage detecting circuit detects the lamp voltage by subtracting a voltage in proportion to a sum of voltage drops across devices lying on a current path over which the lamp current flows other than the discharge lamp from a voltage in proportion to the dc voltage.

20 Claims, 7 Drawing Sheets

DISCHARGE LAMP LIGHTING APPARATUS

BACKGROUND OF THE INVENTION

1. Field of the Invention

The present invention relates to a discharge lamp lighting apparatus for controlling lighting of a discharge lamp, particularly a high-pressure discharge lamp for use in a vehicle headlight.

2. Description of the Background Art

There have been proposed various types of discharge lamp lighting apparatuses configured to step up an output voltage of a vehicle-mounted battery into a high voltage by use of a transformer, invert the polarities of the high voltage by use of an inverter in order to light a high-pressure discharge lamp mounted on a vehicle as a headlight on an alternating basis. For example, refer to Japanese Patent Application Laid-Open No. 8-321389.

In such control apparatuses, the electric power supplied to the lamp is adjusted by performing PWM (Pulse Width Modulation) control on a switch device lying on a current path over which the primary current of the transformer flows in accordance with a predetermined control curve defining a relationship between a lamp voltage and a lamp current.

To sum up, an output voltage of a DC-DC converter, which is applied to an H-bridge constituting the inverter, makes the lamp voltage. This lamp voltage is used as the basis of calculation of the electric power supplied to the lamp.

Lamps having a rated power of 35 W, a rated lamp voltage of 85V, and a rated lamp current 0.41A have been conventionally used. To use such a lamp as a vehicle headlight, it is necessary to boot up the light beam, or to make the lamp bright promptly after turning on a lighting switch, and so the lamp is supplied with electric power greater than the rated power in the initial lighting stage.

To give an actual example for a conventional 35 W-lamp (D2S bulb or D2R bulb), the lamp power is controlled such that it is about 75 W in the initial lighting stage, and is decreased gradually to the rated power of 35 W in the stable lighting stage. This lamp power control is performed in accordance with a prescribed control curve defining a relationship between the lamp voltage and the lamp current. For example, by setting the lamp voltage at about 27V in the initial lighting stage and at 85 V in the stable lighting stage, that is, by raising the lamp voltage by 85−27=58 (V), the lamp power can be changed from 75 W to 35 W.

Incidentally, in consideration of environmental pollution, it is desirable to use mercury-less or mercury-free lamps instead of conventional lamps containing a trace quantity of mercury.

In the case of using the mercury-less lamp as a vehicle headlight, it is also necessary to boot up the light beam, or to make the lamp bright promptly after turning on the lighting switch. Accordingly the mercury-less lamp has to be supplied with electric power greater than its rated power in the initial lighting stage. Generally, when using a 35 W-lamp of the mercury-less type, electric power of about 90 W is supplied to the lamp in the initial lighting stage, and is decreased gradually to 35 W in the stable lighting stage. The lamp voltage of the mercury-less lamp in the stable lighting stage is approximately half the voltage lamp of the conventional lamp in the stable lighting stage, whereas the lamp voltage of the mercury-less lamp in the initial lighting stage is approximately equal to the lamp voltage (27V) of the conventional lamp in the initial lighting stage.

When the lamp power control is performed for the mercury-less lamp by use of the above mentioned control curve as in prior art, the lamp power (electric power supplied to the lamp) is set at 90 W in the initial lighting stage and is decreased gradually to be 35 W in the stable lighting stage by changing the lamp voltage from 27V to 42V. In the conventional lamp, the voltage variation required for changing the lamp power by 75 W−35 W=35 W is 85V−27V=58V, whereas in the mercury-less lamp, the voltage variation required for changing the lamp power by 90 W−35 W=55 W is 42V−27V=15V. The ratio of the lamp power variation to the lamp voltage variation in the mercury-less lamp's case is greater than that in the conventional lamp's case.

The above-described lamp voltage variation and the lamp power variation will be explained below in more detail by way of an example.

The lamp voltage used as the basis of calculating the lamp power is a voltage outputted from the DC-DC converter and applied to the H-ridge constituting the inverter as disclosed in the Japanese Patent Application Laid-Open No. 8-321389. To be more precise, a voltage drop across the lamp itself (referred to as "true lamp voltage" hereinafter) added by other voltage drops across other devices such as switch devices, a high-voltage generating coil, etc makes the lamp voltage which is used as the basis of calculation of the lamp power.

The following shows the value of the lamp voltage for each of the case of using the conventional lamp and the case of using the mercury-less lamp, assuming that the inverter (H bridge) is constituted by MOS transistors having on resistance of 0.7 ohms and the coil resistance of the high-voltage generating coil is 1.5 ohms.

In the conventional lamp's case, the lamp current is 2.6A in the initial lighting stage where the electric power supplied to the lamp is 70 W and the true lamp voltage is 27V, while it is 0.41A in the stable lighting state where the electric power supplied to the lamp is 35 W and the true lamp voltage is 85V. The voltage applied to the inverter in the initial lighting stage is calculated according to the following equation 1.

$$27+(0.7\times2\times2.6)+(1.5\times2.6)=34.54(V) \quad \text{Equation 1}$$

The voltage applied to the inverter in the initial lighting stage is calculated as follows.

$$85+(0.7\times2\times0.41)+(1.5\times0.41)=86.2(V) \quad \text{Equation 2}$$

Thus, the variation of the voltage applied to the inverter is 86.2−34.54=51.7V.

In the mercury-less lamp's case, the lamp current is 3.3A in the initial lighting stage where the electric power supplied to the lamp is 90 W and the true lamp voltage is 27V, while it is 0.83A in the stable lighting stage where the electric power supplied to the lamp is 35 W and the true lamp voltage is 42V. The voltage applied to the inverter in the initial lighting stage is calculated as follows.

$$27+(0.7\times2\times9.3)+(1.5\times3.3)=36.57(V) \quad \text{Equation 3}$$

The voltage applied to the inverter in the stable lighting stage is calculated as follows.

$$42+(0.7\times2\times0.83)+(1.5\times0.83)=44.4(V) \quad \text{Equation 4}$$

Thus, the variation of the voltage applied to the inverter is 44.4−36.57=7.83V

As described above, in the conventional lamp's case, the variation of the voltage applied to the inverter is 51.7V which is smaller by about 6% than the variation of the true lamp voltage which is 58V, since the voltage applied to the inverter includes not only the voltage drop across the lamp, but also the voltage drops across the devices other than the lamp. However, since the variation of the voltage applied to the inverter, which is 51.7V, is relatively large, the contribution ratio of the voltage drops across the devices other than the lamp inn the variation of the lamp voltage are relatively small. Accordingly, it is possible to control the lamp power accurately without difficulty by use of a lamp power calculating circuit designed with consideration given to the effects of the voltage drops across the devices other than the lamp and device-to-device variation.

On the other hand, in the mercury-less lamp's case, the variation of the voltage applied to the inverter is 7.83V which is smaller by about 48% than the variation of the true lamp voltage which is 15V. Since the variation of the voltage applied to the inverter, which is 7.83V, is relatively small, the contribution ratio of the voltage drops across the devices other than the lamp in the variation of the lamp voltage are relatively large. As explained above, to control the electric power supplied to the mercury-less lamp by controlling the voltage applied to the inverter as in prior art, it is necessary to vary the lamp power by 55 W by varying the voltage supplied to the inverter by the value as small as 7.83V. Accordingly, it is difficult to control the lamp power accurately by use of the lamp power calculating circuit even if it is designed with consideration given to the effects of the voltage drops across the devices other than the lamp and device-to-device variation.

As explained above, if the variation of the voltage supplied to the inverter is large as in the conventional lamp's case, the effects of the voltage drops across the devices other than the lamp on the lamp power control are small, since the contribution ratio of the voltage drops across the devices other than the lamp in the lamp voltage variation is small.

However, if the variation of the voltage supplied to the inverter is small as in the mercury-less lamp's case, the effects of the voltage drops across the devices other than the lamp on the lamp power control is large, since the contribution ratio of the voltage drops across the devices other than the lamp in the lamp voltage variation is large.

As a result, there arises a problem in that the build up characteristic of the vehicle headlight's beam defined in the regulation cannot be satisfied by controlling the voltage applied to the inverter as in prior art in the mercury-less lamp's case.

SUMMARY OF THE INVENTION

The present invention has been made in light of the above-described problem with an object of providing a discharge lamp lighting apparatus capable of controlling accurately the electric power supplied to the discharge lamp even if the lamp voltage variation between the initial lighting stage and the stable lighting stage is small.

The object can be achieved by a discharge lamp lighting apparatus having a structure including:

a high-voltage generating coil connected in series to a discharge lamp for applying a high voltage to the discharge lamp to turn on the lamp;

an inverter for inverting a dc voltage into an ac voltage in order to supply a lamp current to the discharge lamp on an alternating basis through the high voltage generating coil;

a lamp voltage detecting circuit for detecting a voltage across the discharge lamp as a lamp voltage; and a lamp power control circuit for controlling an ac power supplied to the discharge lamp from the inverter on the basis of the lamp voltage detected by the lamp voltage detecting circuit;

wherein the lamp voltage detecting circuit detects the lamp voltage by subtracting a voltage in proportion to a sum of voltage drops across devices lying on a current path over which the lamp current flows from the inverter to the discharge lamp other than the discharge lamp from a voltage in proportion to the dc voltage.

With this structure, it is possible to determine the lamp power solely on the basis of the true lamp voltage without being affected by the voltage drops across the devices other than the discharge lamp such as the high voltage generating coil, the lamp current detecting resistor, and semiconductor switch device. Accordingly it becomes possible to control accurately the electric power supplied to the discharge lamp even if the lamp voltage variation between the initial lighting stage and the stable lighting stage is small as in the case of using a mercury-less lamp as the discharge lamp.

The lamp voltage detecting circuit may subtract at least a voltage drop across the high voltage generating coil from the voltage in proportion to the dc voltage.

The lamp voltage detecting circuit may subtract at least a voltage drop across a semiconductor switch device included in the inverter circuit from the voltage in proportion to the dc voltage.

The discharge lamp lighting apparatus may further include a lamp current detecting resistor through which the lamp current flows, the lamp voltage detecting circuit determining the sum of the voltage drops across the devices other than the discharge lamp on the basis of the voltage drop across the lamp current detecting resistor.

The lamp voltage detecting circuit may have a first voltage detecting circuit for detecting a first sum of voltage drops across the devices and a voltage drop across the discharge lamp on the basis of the dc voltage, a second voltage detecting circuit for detecting a second sum of the voltage drops across the devices on the basis of the lamp current, and a subtraction circuit for subtracting the second sum from the first sum.

The lamp voltage detecting circuit may have a first voltage detecting circuit for detecting a first sum of voltage drops across the devices including a semiconductor switch device within the inverter and a voltage drop across the discharge lamp on the basis of the dc voltage, a second voltage detecting circuit for detecting a second sum of voltage drops across the devices other than the semiconductor switch device on the basis of the lamp current, a voltage generating circuit for generating a voltage equivalent to a voltage drop across the semiconductor switch device, and a subtraction circuit for subtracting the second sum and the voltage generated by the voltage generating circuit from the first sum. In this case, the semiconductor switch may be made of a MOS transistor, and the voltage generating circuit may generate the voltage equivalent to the voltage drop across the semiconductor switch device by dividing down a constant voltage by a predetermined dividing ratio.

The lamp voltage detecting circuit may have a sample-and-hold circuit configured to sample the dc voltage within a time frame which is after a lapse of 1/30 a duration of a half polarity-changing cycle of the inverter from a start of the half polarity-changing cycle and is within 1/3 the duration of the start.

The lamp power control circuit may control the ac power supplied to the discharge lamp by gradually increasing the lamp voltage from a predetermined initial voltage to a predetermined saturation voltage, a difference between the initial voltage and the saturation voltage being equal to or smaller than 50V, 40V, 30V, or 20V.

The present invention is particularly advantageous when the difference between the initial voltage and the saturation voltage is small.

PREFERRED EMBODIMENTS OF THE INVENTION

First Embodiment

Figure 1:
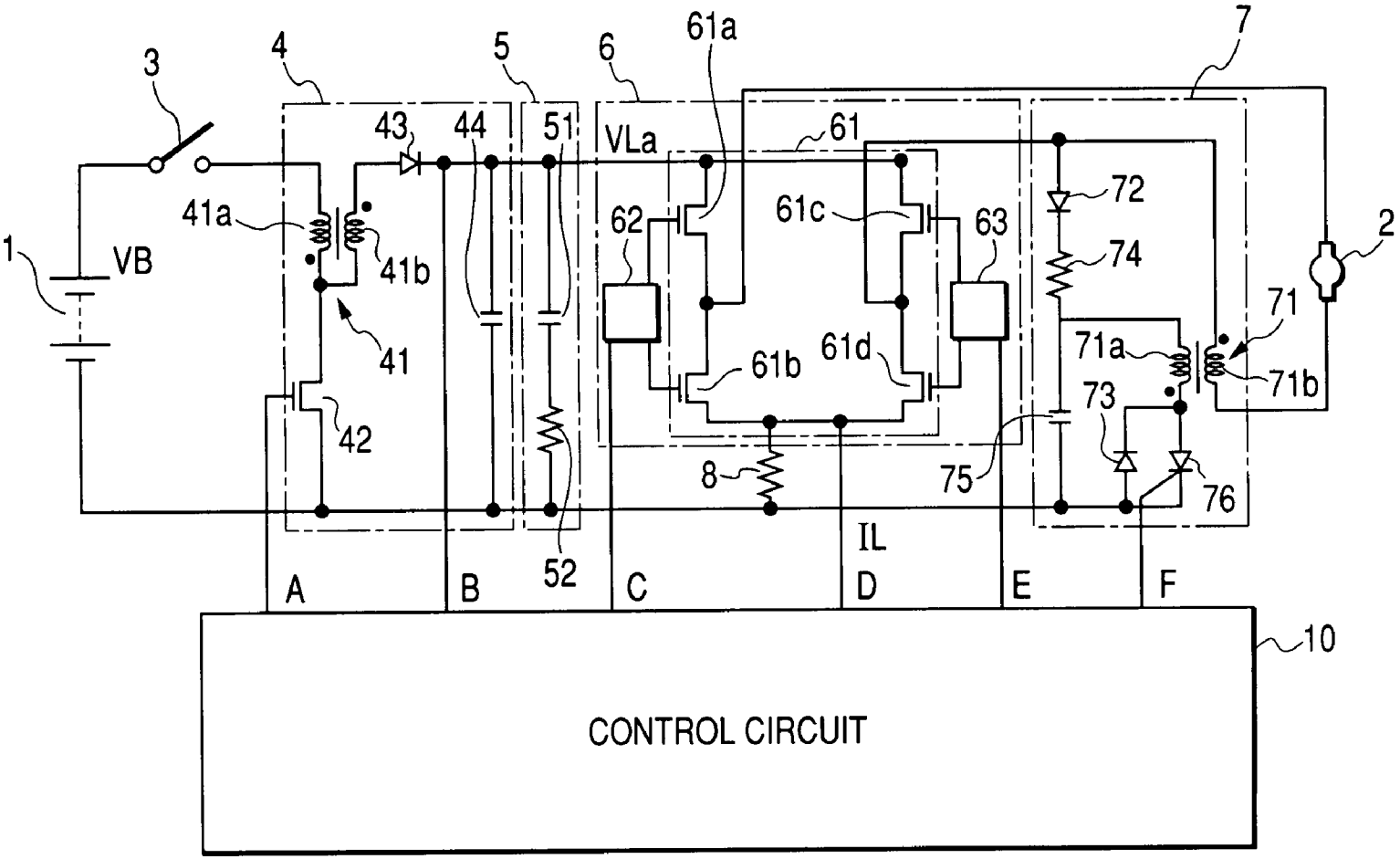
FIG. 1 is a circuit diagram of a discharge lamp lighting apparatus according to a first embodiment of the invention.

FIG. 1 shows an overall structure of a discharge lamp lighting apparatus of the invention used for controlling the lighting of a vehicle headlight.

The discharge lamp lighting apparatus is connected, through a lighting switch 3, to a vehicle-mounted battery 1 serving as a dc power supply, and operates to put on and out a high-pressure discharge lamp (vehicle headlight) 2 in response to on/off operation of the lighting switch 3.

The discharge lamp lighting apparatus includes a DC power supply circuit (DC-DC converter) 4, a takeover circuit 5, an inverter circuit 6, a starter circuit 7, and a lamp current detecting resistor 8.

The DC-DC converter 4 includes a flyback transformer 41 having a primary coil 41*a* on the battery 1 side and a secondary coil 41*b* on the lamp 2 side, a MOS transistor 42 used as a semiconductor switch connected to the primary coil 41*a*, a rectifying diode 43 connected to the secondary coil 41*b*, and a smoothing capacitor 44. The DC-DC converter 4 generates a high voltage by stepping up the battery voltage VB.

To be more specific, when the MOS transistor 42 is turned on and a current flows through the primary coil 41*a*, energy is stored in the primary coil 41*a*, and when the MOS transistor 42 is turned off, the energy stored in the primary coil 41*a* is supplied to the secondary coil 41*b*. Through repetition of such an operation, the high voltage appears on the node of the diode 43 and the capacitor 44.

The takeover circuit 5 including a capacitor 51 and a resistor 52 is for shifting the dielectric breakdown between the electrodes of the lamp 2 into the arc discharge between the electrodes by the action of the charged capacitor 51 promptly after the lighting switch 3 is turned on.

The inverter circuit 6 including an H-bridge circuit 61 and bridge driving circuits 62 and 63 is for lighting the lamp 2 on an alternating basis. The H-bridge circuit 61 includes semiconductor switch devices 61*a* to 61*d* arranged in an H-bridge. The bridge driving circuits 62 and 63 turn on and off a combination of the semiconductor switch devices 61*a* and 61*d* and another combination of the semiconductor switch devices 61*b* and 61*c* alternately in accordance with a signal from an H-bridge control circuit 400 (to be hereinafter described). As a result, the polarity of the voltage applied to the lamp 2 and the direction of the discharge current within the lamp 2 alternate. Thus the lamp 2 is lit on an alternating basis.

The starter circuit 7, which is connected to a neutral-potential node of the H-bridge circuit 61 and a negative terminal of the battery 1, includes a transformer 71 having a primary coil 71*a* and a secondary coil 71*b*, diodes 72, 73, a resistor 74, a capacitor 75, and a thyristor 76.

The starter circuit 7 triggers lighting of the lamp 2. That is, when the lighting switch 3 is turned on, the capacitor 75 is charged, and subsequently the thyristor 76 is turned on. In consequence, the capacitor 75 starts discharging so that the lamp 2 is applied with the high voltage through the transformer 71. As a result, a dielectric breakdown occurs between the electrodes of the lamp 2, and so the lamp 2 begins to light up.

The lamp current detecting resistor 8 is for detecting a current flowing through the lamp 2. The lamp current flowing through the lamp 2 can be determined on the basis of the voltage drop across the lamp current detecting resistor 8. More particularly, the voltage drop IL across the lamp current detecting resistor 8 is detected as the lamp current IL indicative of the value of the current flowing through the lamp 2.

The MOS transistor 42, bridge driving circuits 62, 63, and thyristor 76 are controlled by a control circuit 10 which receives the voltage outputted from the DC-DC converter 4 and applied to the inverter circuit 6), the lamp current IL indicative of the value of the current flowing from the inverter circuit 6 to the negative terminal of the battery 1, etc.

Figure 2:
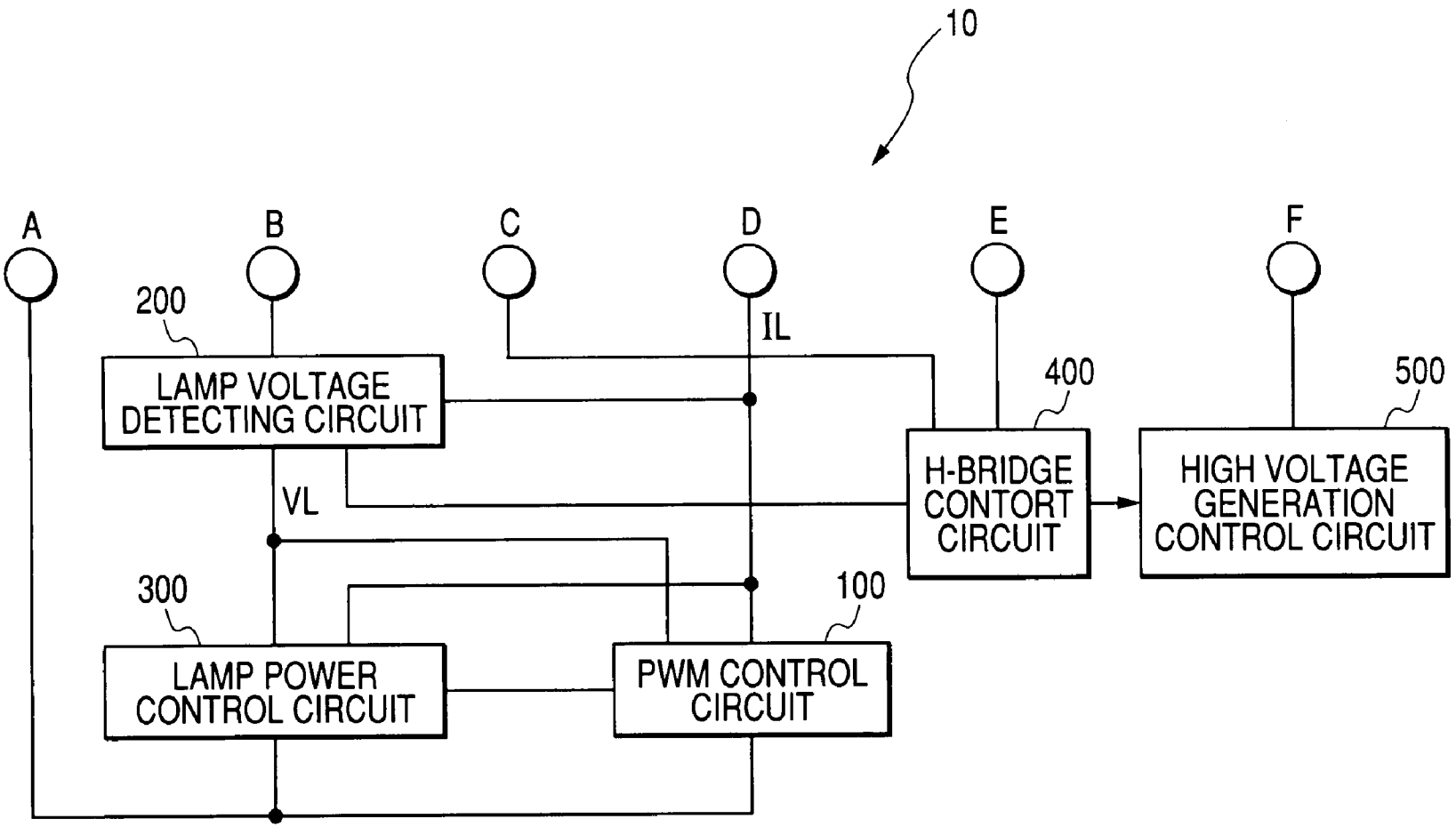
FIG. 2 is a block diagram showing a structure of a control circuit 10 shown in FIG. 1.

FIG. 2 is a block diagram showing a structure of the control circuit 10. As shown in this figure, the control circuit 10 includes a PWM control circuit 100, a lamp voltage detecting circuit 200, a lamp power control circuit 300, an H-bridge control circuit 400, and a high-voltage generation control circuit 500.

The PWM control circuit 100 is for turning on and off the MOS transistor 42 by outputting a PWM signal. The lamp voltage detecting circuit 200 is for converting the voltage applied to the inverter circuit 6 into a lamp voltage VL. The lamp power control circuit 300 is for controlling the electric power supplied to the lamp 2 (lamp power) to a desired value on the basis of the lamp voltage VL and the lamp current IL.

The H-bridge control circuit 400, which is for controlling the H-bridge circuit 61, turns on and off the semiconductor switch devices 61*a* to 61*d* by outputting a control signal to the bridge driving circuits 62, 63. The high-voltage generation control circuit 500 is for generating the high voltage to be applied to the lamp 2 by turning on the thyristor 76.

The operation of the discharge lamp lighting apparatus having the above-described structure will now be explained.

When the lighting switch 3 is turned on, the electric power is supplied to each section of the apparatus shown in FIG. 1, and the MOS transistor 42 is PWM-controlled by the PWM control circuit 100. In consequence, the high voltage resulting from stepping up the battery voltage VB by the action of the flyback transformer 41 is outputted from the DC-DC converter 4.

The H-bridge control circuit 400 turns on and off the combination of the semiconductor switches 61*a* and 61*d* and the other combination of the semiconductor switches 61*b* and 61*c* alternately, so that the high voltage outputted form the DC-DC converter 4 is supplied to the capacitor 75 of the starter circuit 7 through the H-bridge circuit 61, thereby charging the capacitor 75.

Subsequently, the high-voltage generation control circuit 500 outputs a gate drive signal to the thyristor 76 to turn on the thyristor 76 in accordance with a signal which the H-bridge control circuit 400 produces to indicate timing of selection between the combination of the semiconductor switches 61*a*, 61*d* and the combination of the semiconductor switches 61*b*, 61*c*. When the thyristor 76 is turned on, the capacitor 75 is discharged, and accordingly the lamp 2 is applied with the high voltage through the transformer 71. In consequence, a dielectric breakdown between the electrodes of the lamp 2 occurs, and the lamp 2 begins to light.

After that, the polarity of the voltage applied to the lamp 2 (the direction of the discharge current) is alternated by the operation of the H-bridge circuit 61, so that the lamp 2 continues to light on an alternating basis. The lamp power control circuit 300 controls the lamp power at a desired value. The lamp voltage detecting circuit 200 receives the voltage VLa applied to the inverter circuit 6 and converts it into the lamp voltage VL. The lamp power control circuit 300 controls the lamp power on the basis of the lamp voltage VL received from the lamp voltage detecting circuit 200 and the lamp current IL equivalent to the voltage drop across the lamp current detecting resistor 8.

The structure of the lamp power control circuit 300 will be explained below in detail with reference to FIG. 3.

The lamp power control circuit 300 includes an initial lighting voltage storing circuit 320, a ΔVL detecting circuit 350 and an error amplifying circuit 301.

The initial lighting voltage storing circuit 320 is for storing the lamp voltage VL immediately after the lamp 2 is turned on (lit up) and outputting it as an initial lighting voltage VLs.

The ΔVL detecting circuit 350 is for subtracting the initial lighting voltage VLs from the current lamp voltage VL and outputting a lamp voltage variation ΔVL indicative of difference between them.

The error amplifying circuit 301 is for producing a voltage representing the lighting state of the lamp 2 depending on the lamp voltage VL, the lamp current IL, etc. This voltage produced by the error amplifying circuit 301 is supplied to the PWM control circuit 100. The PWM control circuit 100 is configured to increase the lamp power by increasing the duty ratio of the signal applied to the gate of the MOS transistor 42 as the voltage supplied from the error amplifying circuit 301 increases.

The error amplifying circuit 301 receives a reference voltage Vr1 at its noninverting input terminal and a voltage V1 at its inverting terminal as a parameter used for controlling the lamp power, and outputs a voltage depending on the difference between the reference voltage Vr1 and the voltage V1.

The voltage V1 depends on the lamp current IL, a constant current i1, a current i2 set by a first current setting circuit 302, a current i3 set by a second current setting circuit 303, a current i4 set by a third current setting circuit 304, and a current i5 set by a fourth current setting circuit 305.

Figure 3:
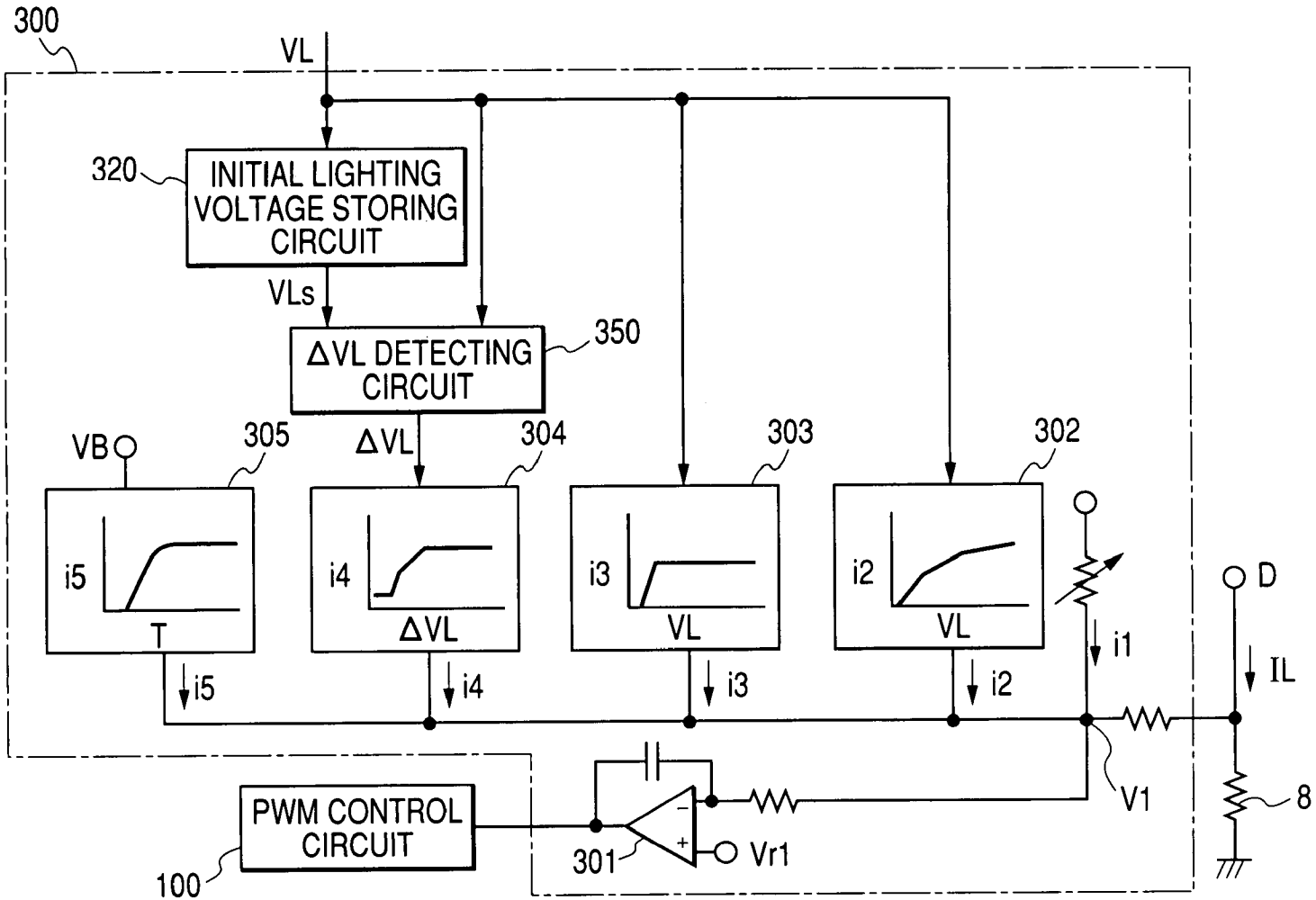
FIG. 3 is a schematic view showing a structure of a lamp power control circuit 300 shown in FIG. 2.

As shown in FIG. 3, the first current setting circuit 302 is configured to increase the setting of the current i2 with the increasing lamp voltage VL. The second current setting circuit 303 is configured to set the current i3 at zero when the lamp voltage VL is equal to or lower than a first predetermined value, set the current i3 at a constant value when the lamp voltage VL is equal to or higher than a second predetermined value, and increase the setting of the current i3 with the increasing lamp voltage VL as long as the lamp voltage VL is higher than the first predetermined value and lower than the second predetermined value. The third current setting circuit 304 is configured to set the current i4 at a constant value when the lamp voltage variation ΔVL is equal to or lower than a first predetermined value, sets the current i4 at another constant value when the lamp voltage variation ΔVL is equal to or higher than a second predetermined value, and increase the setting of the current i4 with the increasing ΔVL as long as the ΔVL is higher than the first predetermined value and lower than the second predetermined value. The fourth current setting circuit 305 is configured to increase the setting of the current i5 with time T elapsed after the lamp 2 is turned on. For example, the fourth current setting circuit 305 sets the current i5 at zero over a predetermined period of time after the lamp 2 is turned on, increases the current i4 with the passage of time T, and sets the current i5 at a predetermined value several tens of seconds after the lamp 2 is turned on.

Alternatively, it is possible to configure the fourth current setting circuit 305 so as to set the current i5 at zero before the ΔVL reaches a predetermined voltage after the lamp 2 is turned on, increases the current i5 with the passage of time after the ΔVL reaches the predetermined voltage, and sets the current i5 at a predetermined value several tens of seconds after the lamp 2 is turned on.

The sum of the currents i1, i2, i3, i4, and i5 is small enough compared to the lamp current IL.

The lamp power control circuit 300 having the above-described structure controls the lamp power by outputting, to the PWM control circuit 100, the voltage depending on the time T elapsed after the lamp 2 is turned on, lamp voltage VL, and lamp voltage variation ΔVL. More specifically, the lamp power is set at a large value (90 W, for example) to boot up the light beam (to make the lamp 2 bright) promptly in the initial lighting stage, decreased gradually with the increasing light beam, and set at a predetermined value (35 W, for example) when the lamp 2 has reached the stable lighting stage.

Next, the structure of the lamp voltage detecting circuit 200 will be explained with reference to FIG. 4.

Figure 4:
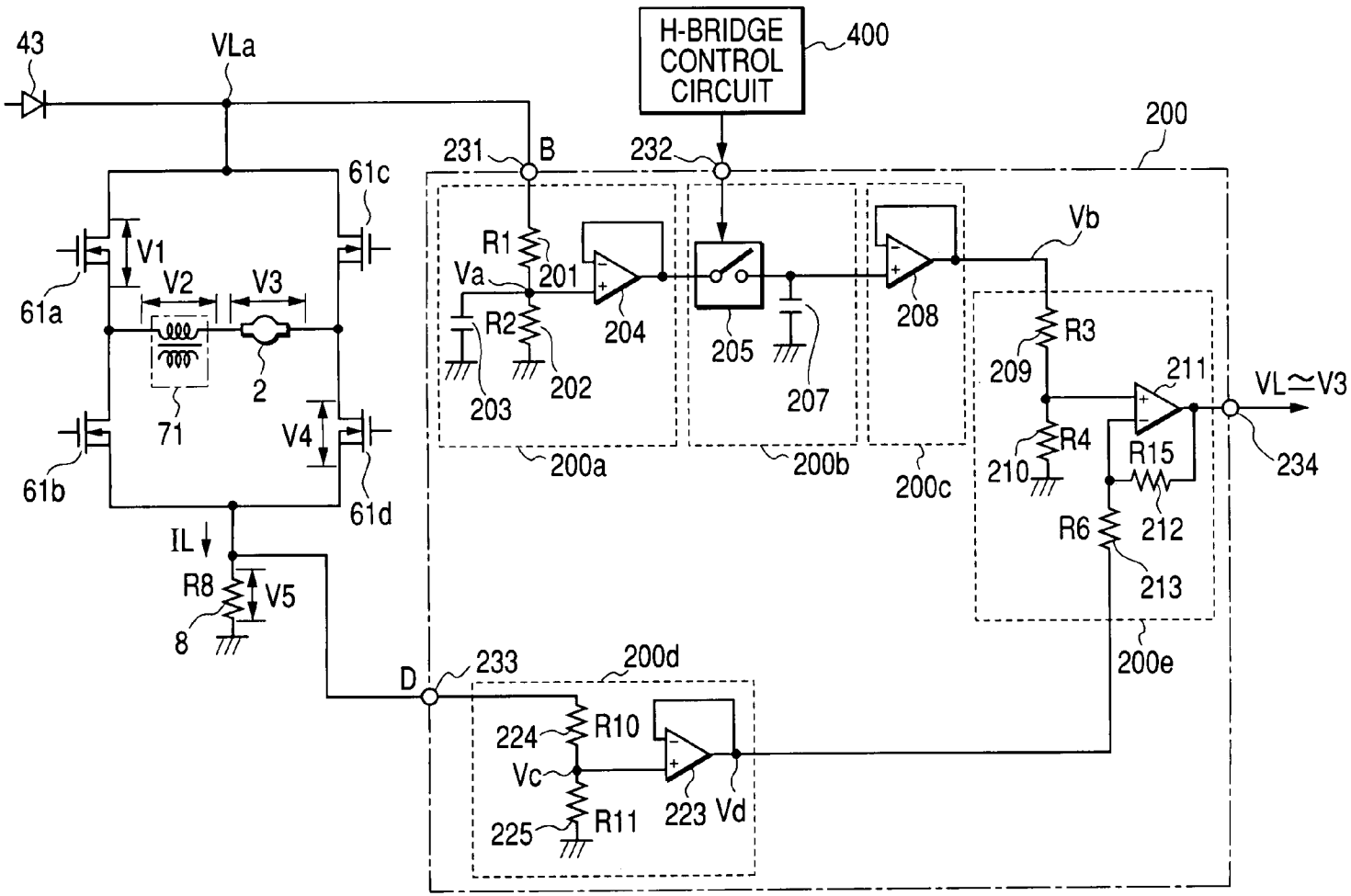
FIG. 4 is a circuit diagram of a lamp voltage control circuit 200 shown in FIG. 2.

In FIG. 4, a part surrounded by a chain line represents the lamp voltage detecting circuit 200. As shown in this figure, the lamp voltage detecting circuit 200 receives the voltage VLa outputted from the DC-DC converter 4 at its input terminal 231 (node B). This voltage VLa, which is equivalent to the sum of voltage drops across the devices lying on the current path over which the lamp current flows, is given by the equation 5.

$$VLa = V1 + V2 + V3 + V4 + V5 \qquad \text{Equation 5}$$

where V1 is a voltage drop across the semiconductor switch device (MOS transistor) 61*a* (or 61*c*) constituting the H-bridge circuit 61, V2 is a voltage drop across the secondary coil of the high-voltage generating transformer 71, V3 is a voltage drop across the lamp 2 (true lamp voltage), V4 is a voltage drop across the semiconductor switch device (MOS transistor) 61*d* (or 61*b*) constituting the H-bridge circuit 61, and V5 is a voltage drop across the lamp current detecting resistor 8. V1, V2, V4, and V5 are given by the following equations 6 to 9, respectively.

$$V1=r61a(\text{or } r61c)\times IL \quad \text{Equation 6}$$

where r61*a* (or r61*c*) is an on resistance of the semiconductor switch device 61*a* (or 61*c*) made of a MOS transistor.

$$V2=r71\times IL \quad \text{Equation 7}$$

where r71 is a resistance of the secondary coil of the high-voltage generating transformer 71.

$$V4=r61d(r61b)\times IL \quad \text{Equation 8}$$

where r61*d* (r61*b*) is an on resistance of the semiconductor switch device 61*d* (or 61*b*) made of a MOS transistor.

$$V5=R8\times IL \quad \text{Equation 9}$$

where R8 is a resistance of the lamp current detecting resistor 8.

Substituting the equations 6 to 9 into the equation 5 yields the following equation 10.

$$VLa=V3+(r61a+r71+r61d+R8)\times IL \quad \text{Equation 10}$$

The voltage VLa inputted into the H-bridge circuit 61 is divided down to a voltage Va by resistors 201 and 202 included in a first voltage detecting circuit 200*a*, and supplied to an operational amplifier 204 serving as a voltage follower circuit for impedance conversion. A capacitor 203 is for reducing voltage ripples caused by the switching operation of the DC-DC converter 4.

Figure 5:
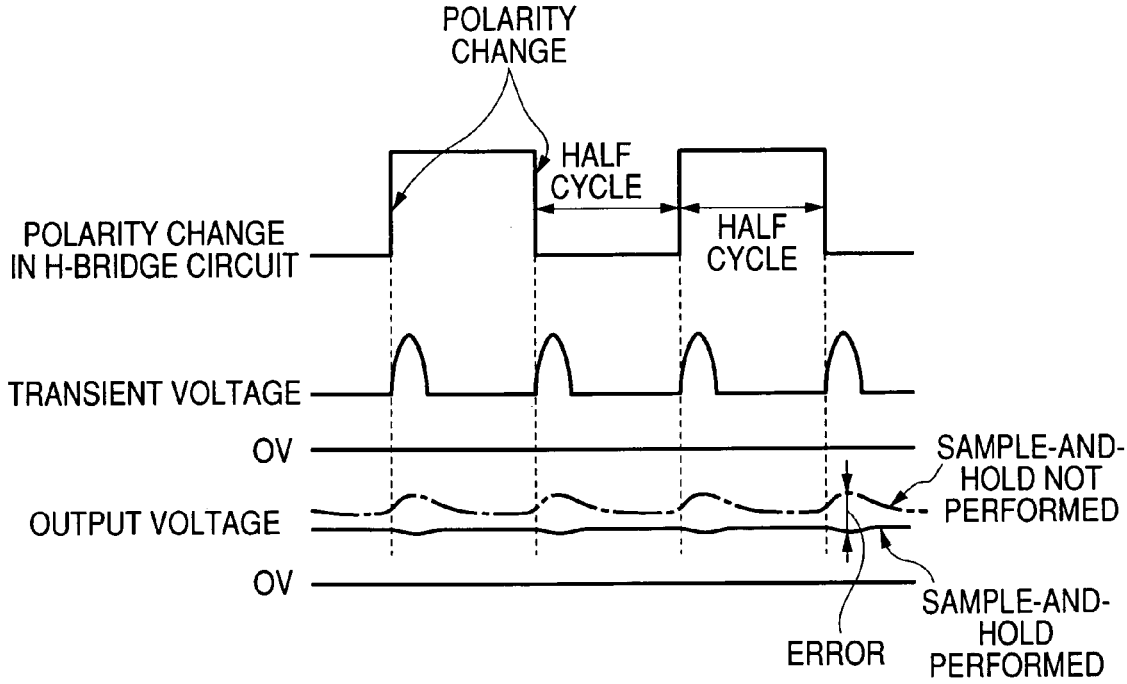
FIG. 5 is a graph showing waveforms of output voltages for giving comparison between a case where a sample-and-hold circuit is provided and a case where the sample-and-hold circuit is not provided.

An output voltage of the operational amplifier 204 is stored in a sample-and-hold circuit 200*b* including a switch 205 and a capacitor 207 in order to eliminate the effects of a transient voltage which the high-voltage generating transformer 71 produces each time the polarity (the direction of the current flowing through the transformer 71) is changed in the H-bridge circuit 61. From FIG. 5 showing waveforms of the transient voltage and the output voltage together with temporal change of the polarity in the H-bridge circuit 61, it can be understood that if the sample-and-hold circuit 200*b* is not provided, a large error occurs in the output voltage.

The operation of the sample-and-hold circuit 200*b* will be explained below in more detail. The switch 205 is on-off controlled by a pulse signal inputted into an input terminal 232 of the lamp voltage detecting circuit 200. This pulse signal, which is in synchronization with the timing of the polarity change in the H-bridge circuit 61, is sent from the H-bridge control circuit 400. Accordingly, the capacitor 207 is charged to the voltage Va resulting from dividing down the voltage VLa by the resistors 201, 202. With this structure, it becomes possible to keep the switch 205 in the off state for a predetermined period of time after the polarity change is executed in the H-bridge circuit 61, thereby masking the transient voltage which the secondary coil of the high-voltage generating transformer produces when the polarity change is executed in the H-bridge circuit 61.

In each of half polarity-changing cycles, if the sample-and-hold operation is performed within 1/30 the duration of the half polarity-changing cycle of the start of the half polarity-changing cycle, it is difficult to obtain a correct sample. On the other hand, if the sample-and-hold operation is performed after a lapse of 1/3 the duration of the half polarity-changing cycle from the start of the half polarity-changing cycle, it is difficult to output a correct sample. Accordingly, it is preferable to perform the sample-and-hold operation after a lapse of 1/30 the duration from the start of the half polarity-changing cycle and within 1/3 the duration of the start of the half polarity-changing cycle.

The sample-and-hold circuit 200*b* outputs a voltage Vb by way of a voltage follower circuit 200*c* including an amplifier 208 for impedance conversion. The voltage Vb is given by the equation 11.

$$Vb=Va=VLa\times(R2/(R+R2))=VLa\times k1 \quad \text{Equation 11}$$

where R1 is a resistance of the resistor 201, and R2 is a resistance of the resistor 202. k1 is given by the equation 12.

$$k1=R2/(R1+R2) \quad \text{Equation 12}$$

Since the transient voltage appearing each time the polarity change is performed in the H-bridge circuit 61 is masked or eliminated, the voltage Vb just after the polarity change is performed is the same as the voltage Vb just before the polarity change is performed.

As explained above, the provision of the sample-and-hold circuit enables detecting the voltage Vb while eliminating the effects of the transient voltage, and therefore improving control accuracy.

Substituting the equation 11 into the equation 10 yields the following equation 13.

$$Vb=V3\times k1+(r61a+r71+r61d+R8)\times IL\times k1 \quad \text{Equation 13}$$

The lamp voltage detecting circuit 200 receives the voltage V5 across the lamp current detecting resistor 8 at its input terminal 233 (node D). This voltage V5 is divided down into a voltage Vc by a resistor 224 and a resistor 225 constituting a second voltage detecting circuit 200*d*, and outputted through an operational amplifier 223 serving as a voltage follower circuit for impedance conversion. An output voltage Vd of the operational amplifier 223 is given by equation 14.

$$Vd=Vc=V5\times(R11/(R10+R11))=V5\times k2=R8\times IL\times k2 \quad \text{Equation 14}$$

where R10 is a resistance of the resistor 224, and R11 is a resistance of the resistor 225. k2 is given by the following equation 15.

$$k2=R11/(R10+R11) \quad \text{Equation 15}$$

where R8 is a resistance of the current detecting resistor 8, and IL is the lamp current flowing through the lamp 2.

The voltages Vb and Vd given by the equations 13 and 14 are inputted to a subtraction circuit 200*e* including resistors 209, 210, 212, 213, and an operational amplifier 211. The resistors 209, 210, 212, 213 have the same resistance (R3=R4=R5=R6) in order to output the voltage VL equal to the difference between the voltage Vb and voltage Vd from an output terminal 234 of the lamp voltage detecting circuit 200.

The voltage VL (=Vb−Vd) is given by the following equation 16 derived by substituting the equations 13, 14 into the equation of VL=Vb−Vd.

$$VL=(V3\times k1+(r61a+r71+r61d+R8)\times IL\times k1)-(R8\times IL\times k2) \quad \text{Equation 16}$$

If k2 is set at a value satisfying the equation 17, that is, if the equation 18 holds, the equation 19 is derived.

$$(r61a+r71+r61d+R8)\times IL\times k1=(R8\times IL\times k2) \quad \text{Equation 17}$$

$$k2<(r61a+r71+r61d+R8)\times k1/R8 \quad \text{Equation 18}$$

$$VL-V3\times k1 \quad \text{Equation 19}$$

If the equation 19 holds, it means that the lamp voltage detecting circuit 200 outputs the voltage VL which is in proportion solely to the true lamp voltage V3 and not to the sum of the true lamp voltage V3, the voltage drops V1, V4 across the switch devices 61*a*, 61*d*, the voltage drop V2 across the secondary coil of the high-voltage generating transformer 71, and the voltage drop V5 across the lamp current detecting resistor 8.

The voltage Va produced by dividing down the voltage VLa outputted from the DC-DC converter 4 and applied to the input terminal 231 (node B) of the lamp voltage detecting circuit 200 is in proportion to the voltage inputted into the H-bridge circuit 6. Accordingly, the voltage Va includes not oly the true lamp voltage V3 but the voltage drops V1, V4 of the switch devices 61*a*, 61*d*, the voltage drop V2 across the secondary coil of the high-voltage generating transformer 71, and the voltage drop V5 across the lamp current detecting circuit 8.

The voltage drops V1, V4 of the switch devices 61*a*, 61*d*, the voltage drop V2 across the secondary coil of the high-voltage generating transformer 71, and the voltage drop V5 across the lamp current detecting circuit 8 are substantially in proportion to the lamp current IL, respectively. Accordingly, by determining the resistances of the resistors R10 and R11 provided for dividing down the voltage applied to the input terminal 233 (node D), which is equivalent to the voltage drop across the lamp voltage detecting resistor 8, while taking account of all of the voltage drops V1, V2, V4, V5, it becomes possible to obtain the voltage Vc which is in proportion to the sum of the voltage drops V1 V2, V4, V5.

Thus, by subtracting the voltage Vd obtained by performing the impedance conversion on the voltage Vc from the voltage Vb obtained by performing the above-described processings including the impedance conversion on the voltage Va, that is to say, by subtracting the voltage Vd proportionate to the sum of the voltage drops V1, V2, V4, V5 from the voltage Vb proportionate to the sum of the true lamp voltage V3 and the voltage drops V1, V2, V4, V5, the voltage VL proportionate solely to the true lamp voltage V3 can be picked up.

As explained above, in this embodiment, the voltage VL in proportion solely to the true lamp voltage V3 is picked up, and this voltage VL is supplied to the initial lighting voltage storing circuit 320 and the ΔVL detecting circuit 350 to calculate the lamp power.

Accordingly, with this embodiment, it is possible to determine the lamp power solely on the basis of the true lamp voltage V3 without being affected by the voltage drops V1, V4 across the switch devices 61*a*, 61*d*, the voltage drop V2 across the secondary coil of the high-voltage generating transformer 71, and the voltage drop V5 across the lamp current detecting circuit 8. This embodiment enables controlling accurately the electric power supplied to the discharge lamp even if the lamp voltage variation between the initial lighting stage and the stable lighting stage is small as in the mercury-less lamp's case.

Second Embodiment

In the first embodiment, MOS transistors are used as the semiconductor switch devices 61*a* to 61*d* constituting the H-bridge circuit 61, whereas in the second embodiment, IGBTs (Insulated Gate Bipolar Transistors) are used instead of the MOS transistors.

When MOS transistors are used as the semiconductor switch devices 61*a* to 61*d* as is the case with the first embodiment, it is possible to determine the voltage drops of the semiconductor switch devices 61*a* to 61*d* on the basis of the voltage drop across the lamp current detecting resistor 8 through which the lamp current IL flows, because the voltage drop across the MOS transistor used as the semiconductor switch is in proportion to the drain current (equivalent to the lamp current) thereof.

However, when IGBTs are used as the semiconductor switch devices 61*a* to 61*d*, the voltage drops across the semiconductor switch devices 61*a* to 61*d* are substantially constant and independent of their collector currents (equivalent to the lamp current). Accordingly, in this embodiment, the voltage drops across the semiconductor switch devices 61*a* to 61*d* are determined without referring to the lamp current IL.

Since the structure of the discharge lamp lighting apparatus according to the second embodiment is the same as that according to the first embodiment except for the lamp voltage detecting circuit 200, the explanation of the second embodiment set forth below focuses on the lamp voltage detecting circuit 200.

Figure 6:
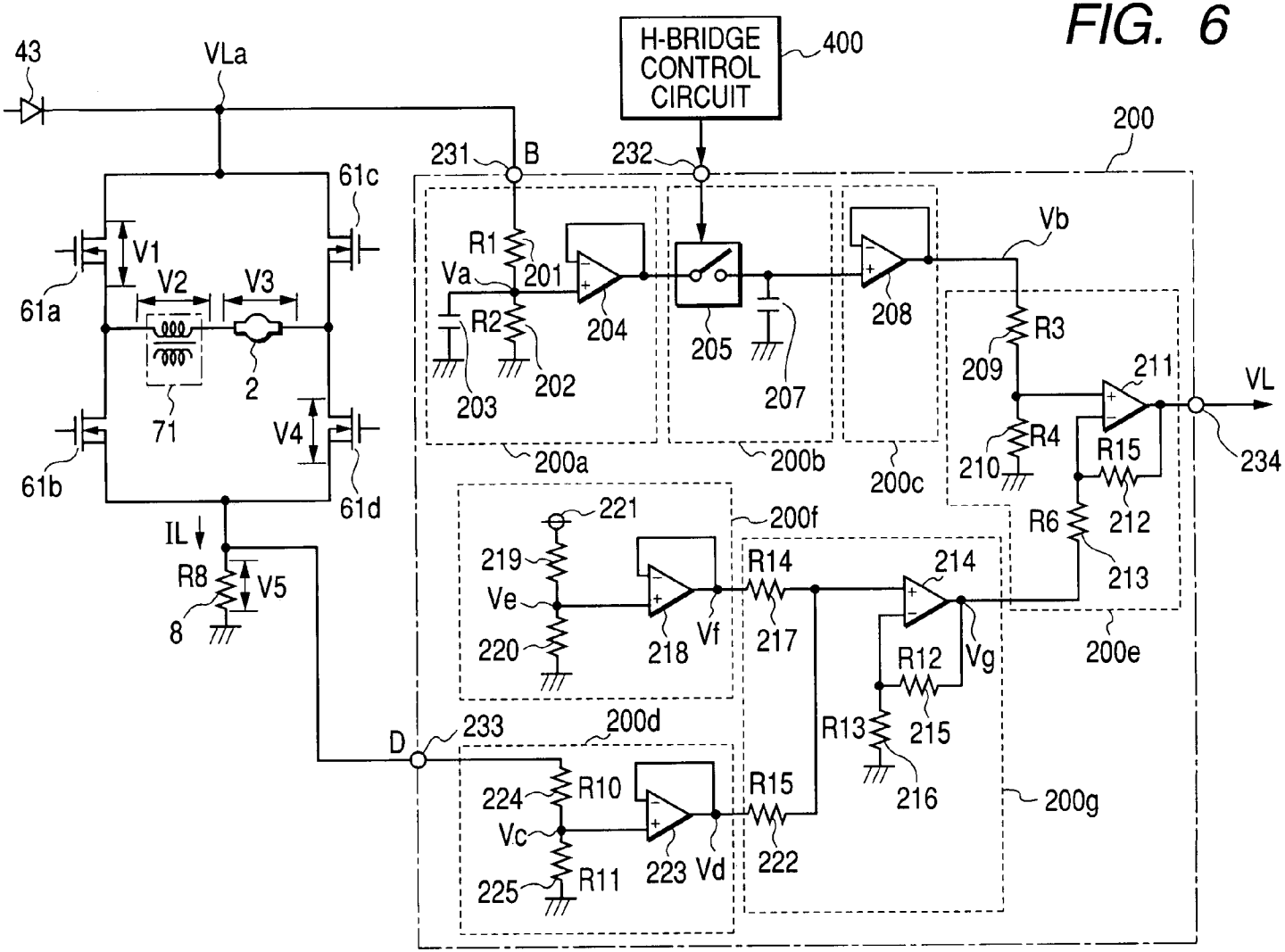
FIG. 6 is a circuit diagram of a lamp voltage control circuit 200 included in a discharge lamp lighting apparatus according to a second embodiment of the invention.

FIG. 6 is a circuit diagram of the lamp voltage detecting circuit 200 of the discharge lamp lighting apparatus according to the second embodiment.

In FIG. 6, a part surrounded by a chain line represents the lamp voltage detecting circuit 200. As shown in this figure, the lamp voltage detecting circuit 200 receives the voltage VLa outputted from the DC-DC converter 4 at its input terminal 231 (node B). This voltage VLa, which is equivalent to the sum of voltage drops V1 to V5 across the devices lying on the current path over which the lamp current flows, is given by the equation 20.

$$VLa=V1+V2+V3+V4+V5 \quad \text{Equation 20}$$

where V1 is a voltage drop across the semiconductor switch 61*a* (or 61*c*) made of an IGBT of the H-bridge circuit 61, V2 is a voltage drop across the secondary coil of the high-voltage generating transformer 71, V3 denotes a voltage drop across the lamp 2 (true lamp voltage), V4 is a voltage drop across the semiconductor switch 61*d* (or 61*b*) made of an IGBT of the H-bridge circuit 61, and V5 is a voltage drop across the lamp current detecting resistor 8. V2 and V5 are given by the equations 21, 22, respectively.

$$V2=r71\times IL \quad \text{Equation 21}$$

where r71 is the resistance of the secondary coil of the high-voltage generating transformer 71.

$$V5=R8\times IL \quad \text{Equation 22}$$

where R8 is the resistance of the lamp current detecting resistor 8.

Substituting the equations 21 and 22 into the equation 20 yields the following equation 23.

$$VLa=V3+V1+V4+(r71+R8)\times IL \quad \text{Equation 23}$$

The voltage VLa inputted into the H-bridge circuit 61 is divided down to the voltage Va by the resistors 201 and 202 included in the first voltage detecting circuit 200*a*, and supplied to the operational amplifier 204 serving as a voltage follower circuit for impedance conversion. The capacitor 203 is for reducing voltage ripples caused by the switching operation of the DC-DC converter 4.

The output voltage of the operational amplifier 204 is stored in the sample-and-hold circuit 200*b* including the switch 205 and the capacitor 207 to eliminate the effects of the transient voltage which the high-voltage generating transformer 71 produces each time the polarity (the direction of the current flowing through the transformer 71) is changed in the H-bridge circuit 61. The operation of the sample-and-hold circuit 200*b* is the same as that in the first embodiment.

The sample-and-hold circuit 200*b* outputs the voltge Vb by way of the voltage follower circuit 200*c* including the amplifier 208 for impedance conversion. The voltage Vb is given by the equation 24.

$$Vb=Va=VLa\times(R2/(R1+R2))=VLa\times k1 \quad \text{Equation 24}$$

where R1 is the resistance of the resistor 201, and R2 is the resistance of the resistor 202. k1 is given by the following equation 25.

$$k1=R2/(R1+R2) \quad \text{Equation 25}$$

Substituting the equation 24 into the equation 23 yields the following equation 26.

$$Vb=V3\times k1+(r61a+r71+r61d+R8)\times IL\times k1 \quad \text{Equation 26}$$

The lamp voltage detecting circuit 200 receives the voltage across the lamp current detecting resistor 8 shown in FIG. 1 at its input terminal 233 (node D) This voltage is divided down into the voltage Vc by the resistors 224 and 225 constituting the second voltage detecting circuit 200*d* and outputted through the operational amplifier 223 serving as a voltage follower circuit for impedance conversion The output voltage Vd of the operational amplifier 223 is given by the equation 27.

$$Vd=Vc=V5\times(r11/(r10+r11))=V5\times k2=r8\times IL\times k2 \quad \text{Equation}$$

where R10 is the resistance of the resistor 224, and R11 is the resistance of the resistor 225. k2 is given by the equation 28.

$$k2-r11/(r10+R11) \quad \text{Equation 28}$$

where R8 is the resistance of the current detecting resistor 8, and IL is the lamp current flowing through the lamp 2.

The discharge lamp lighting apparatus according to this embodiment is further provided with a voltage generating circuit as a third voltage detecting circuit 200*f*. This third voltage detecting circuit 200*f* is for generating a voltage equivalent to the voltage drops across the semiconductor switch devices 61*a* to 61*d*. A terminal 221 of the third voltage detecting circuit 200*f* is connected to a constant voltage source. The constant voltage produced by the constant voltage source and applied to the terminal 221 is divided down into a voltage Ve by a resistor 219 and a resistor 220, and outputted as a voltage Vf (=Ve) through an operational amplifier 218 serving as a voltage follower circuit for impedance conversion.

The voltages Vd and Vf are inputted to an adding circuit including resistors 217, 222, 215, 216 and an operational amplifier 214. The resistors 217, 222, 215, 216 have the same resistance (R12=R13=R14=R15) in order to output a voltage Vg equal to the sum of the Voltage Vf and the voltage Vd from an output terminal of the operational amplifier 214. The voltage Vg is given by the equation 29.

$$Vg=Vf+Vd=Ve+R8\times IL\times k2 \quad \text{Equation 29}$$

The voltages Vb and Vg given by the equations 26 and 29 are inputted to the subtraction circuit 200*e* including the resistors 209, 210, 212, 213, and the operational amplifier 211. The resistors 209, 210, 212, 213 have the same resistance (R3=R4=R5=R6) in order to output the voltage VL equal to the difference between the voltage Vb and the voltage Vg from the output terminal 234 of the lamp voltage detecting circuit 200.

The voltage VL (=Vb−Vd) is given by the following equation 30 derived by substituting the equations 26 and 29 into the equation of VL=Vb−Vd.

$$VL=V3\times k1+(V1+V4)\times k1+(r71+R8)\times IL\times k1-(Ve+R\ IL\times k2) \quad \text{Equation 30}$$

If Ve is set at a value satisfying the equation 31 and k2 is set at a value satisfying the equation 32, that is, if the equation 33 holds, the equation 34 is derived.

$$Ve(V1+V4)\times k1 \quad \text{Equation 31}$$

$$(r71+R8)\times IL\times k1=R8\times IL\times k2 \quad \text{Equation 32}$$

$$k2=(r71+R8)\times k1/R8 \quad \text{Equation 33}$$

$$VL=V3\times k1 \quad \text{Equation 34}$$

If the equation 34 holds, it means that the lamp voltage detecting circuit 200 outputs the voltage VL which is in proportion solely to the true lamp voltage V3, and not to the sum of the true lamp voltage V3, the voltage drops V1, V4 across the switch devices 61*a*, 61*d*, the voltage drop V2 across the secondary coil of the high-voltage generating coil 71, and the voltage drop V5 across the lamp detecting resistor 8.

The voltage Va produced by dividing down the voltage VLa outputted from the DC-DC converter 4 and applied to the input terminal 231 (node B) of the lamp voltage detecting circuit 200 is in proportion to the voltage inputted into the H-bridge circuit 6. Accordingly, the voltage Va includes not only the true lamp voltage V3 but the voltage drops V8, V4 of the switch devices 61*a*, 61*d*, the voltage drop V2 across the secondary coil of the high-voltage generating transformer 71, and the voltage drop V5 across the lamp current detecting circuit B.

The voltage drop V2 across the secondary coil of the high-voltage generating transformer 71, and the voltage drop V5 across the lamp current detecting circuit 8 are substantially in proportion to the lamp current IL, respectively. Accordingly, by determining the resistances of the resistors R10 and R11 provided for dividing down the voltage applied to the input terminal 233 (node D), which is equivalent to the voltage drop across the lamp voltage detecting resistor 8, while taking account of the voltage drops V2 and V5, it becomes possible to obtain the voltage Vc which is in proportion to the sum of the voltage drops V2 and V5.

Since the voltage drops across the switch devices 61*a* and 61*d* are substantially constant, it is possible to obtain the voltage Ve proportionate to the sum of the voltage drops V1 and V4 across the switch devices 61*a* and 61*d* by dividing down, by use of the resistors 219, 220, the voltage produced by the constant voltage source.

Thus, by subtracting the voltage Vd obtained by performing the impedance conversion processing on the voltage Vc and the voltage Vf obtained by performing the impedance conversion processing on the voltage Ve from the voltage Vb obtained by performing the above-described processings including the impedance conversion on the voltage Va, that is to say, by subtracting the voltage Vd proportionate to the sum of the voltage drops V2, V5 and the voltage Vf proportionate to the sum of the voltage drops V1, V4 from the the voltage Vb proportionate to the sum of the true lamp voltage V3 and the voltage drops V1, V2, V4, V5, the voltage VL proportionate solely to the true lamp voltage V3 can be picked up.

As explained above, in the case of using IGBTs as the semiconductor switch devices 61*a* to 61*d*, it is possible to pick up the voltage VL which is in proportion solely to the true lamp voltage V3. By supplying this voltage VL to the initial lighting voltage storing circuit 320 and the ΔVL detecting circuit 350 to calculate the lamp power, the same advantages as the first embodiment can be obtained.

Other Embodiments.

Each of the above-described embodiments is configured to pick up the voltage VL which is in proportion solely to the true lamp voltage by eliminating all of the voltage drops V1, V2, V4, V5.

However, by eliminating at least one (preferably at least two) of the voltage drops V1, V2, V4, V5, it is also possible to control the lamp power more accurately than the prior art, since the voltage used for calculating the lamp power when at least one of the voltage drops V1, V2, V4, V5 is removed is closer to the true lamp voltage than that used in the prior art where none of the voltage drops V1, V2, V4, V5 is eliminated.

Although the above-described embodiments are for controlling the lighting of the mercury-less lamp, it is needless to say that the present invention is applicable to the case of controlling the light of the conventional mercury lamp.

The present invention is effective on a case where the lamp voltage variation of the mercury lamp or the mercury-less lamp between the initial lighting stage and the stable lighting stage is within 50V.

The present invention is more effective on a case where the lamp voltage variation of the mercury lamp or the mercury-less lamp between the initial lighting stage and the stable lighting stage is within 40V.

The present invention is even more effective on a case where the lamp voltage variation of the mercury lamp or the mercury-less lamp between the initial lighting stage and the stable lighting stage is within 30V.

The present invention is still more effective on a case where the lamp voltage variation of the mercury lamp or the mercury-less lamp between the initial lighting stage and the stable lighting stage is within 20V.

Figure 7:
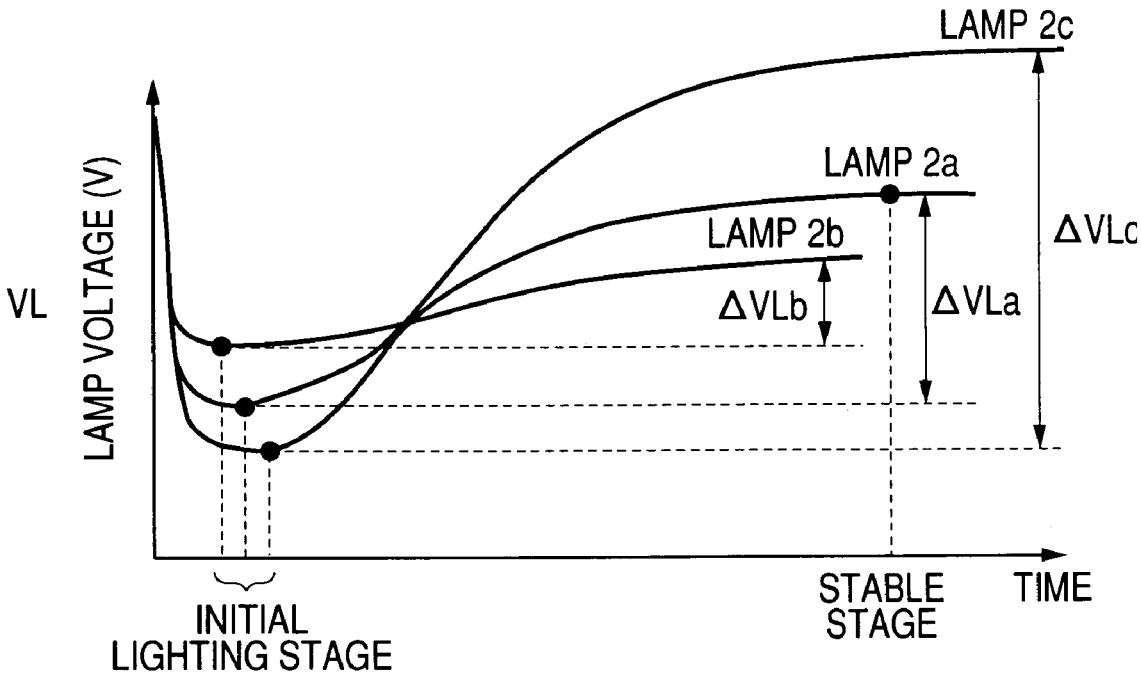
FIG. 7 is a graph showing examples of the lamp voltage variation curve after turning on the discharge lamps.

FIG. 7 is a graph showing examples of the lamp voltage variation curve after turning on the discharge lamp. As shown in this figure, the lamp voltage VL falls rapidly after turning on the lamp to a minimal value, and then rises gradually until it reaches a saturation value. In the above-described embodiments, the lamp voltage VL in the initial lighting stage refers to the minimal value, and the lamp voltage in the stable lighting stage refers to the saturation value. The variation curve ranging from the initial lighting stage to the stable lighting stage varies depending on the lamp used. In FIG. 7, ΔVLa, ΔVLb, and ΔVLc represent the lamp voltage variations of three different lamps 2*a*, 2*b* and 2*c*. The present invention is particularly advantageous for controlling the lighting of the lamp whose lamp voltage variation is small.

The above explained preferred embodiments are exemplary of the invention of the present application which is described solely by the claims appended below. It should be understood that modifications of the preferred embodiments may be made as would occur to one of skill in the art.

What is claimed is:

1. A discharge lamp lighting apparatus comprising:

a high-voltage generating coil connected in a discharge lamp for applying a high voltage to said discharge lamp to turn on said lamp;

an inverter for inverting a dc voltage into an ac voltage in order to supply a lamp current to said discharge lamp on an alternating basis through said high voltage generating coil;

a lamp voltage detecting circuit for detecting a voltage across said discharge lamp as a lamp voltage on the basis of a voltage across a current path on which said high-voltage generating coil and said inverter lie, said lamp current passing in said current path to flow in said discharge lamp; and a lamp power control circuit for controlling an ac power supplied to said discharge lamp from said inverter on the basis of said lamp voltage detected by said lamp voltage detecting circuit;

wherein said lamp voltage detecting circuit detects said lamp voltage by subtracting a voltage in proportion to a sum of voltage drops across devices other than said discharge lamp lying on a current path over which said lamp current flows from a voltage in proportion to said dc voltage.

2. A discharge lamp lighting apparatus according to claim 1, wherein said discharge lamp is a mercury-less lamp.

3. A discharge lamp lighting apparatus according to claim 1, wherein said lamp voltage detecting circuit subtracts at least a voltage drop across said high voltage generating coil from said voltage in proportion to said dc voltage.

4. A discharge lamp lighting apparatus according to claim 1, wherein said lamp voltage detecting circuit is configured to subtract at least a voltage drop across a semiconductor switch device included in said inverter circuit from said voltage in proportion to said dc voltage.

5. A discharge lamp lighting apparatus according to claim 1, further comprising a lamp current detecting resistor through which said lamp current flows, said lamp voltage detecting circuit determining said sum of said voltage drops across said devices other than said discharge lamp on the basis of a voltage drop said lamp current detecting resistor.

6. A discharge lamp lighting apparatus according to claim 1, wherein said lamp voltage detecting circuit has a first voltage detecting circuit for detecting a first sum of voltage drops across said devices and a voltage drop across said discharge lamp on the basis of said dc voltage, a second voltage detecting circuit for detecting a second sum of said voltage drops across said devices on the basis of said lamp current, and a subtraction circuit for subtracting said second sum from said first sum.

7. A discharge lamp lighting apparatus according to claim 1, wherein said lamp voltage detecting circuit has a first voltage detecting circuit for detecting a first sum of voltage drops across said devices including a semiconductor switch device within said inverter and a voltage drop across said discharge lamp on the basis of said dc voltage, a second voltage detecting circuit for detecting a second sum of voltage drops across said devices other than said semiconductor switch device an the basis of said lamp current, a voltage generating circuit for generating a voltage equivalent to a voltage drop across said a semiconductor switch device, and a subtraction circuit for subtracting said second sum and said voltage generated by said voltage generating circuit from said first sum.

8. A discharge lamp lighting apparatus according to claim 7, wherein said semiconductor switch device is made of a MOS transistor, and said voltage generating circuit generates said voltage equivalent to said voltage drop across said semiconductor switch device by dividing down a constant voltage by a predetermined dividing ratio.

9. A discharge lamp lighting apparatus according to claim 1, wherein said lamp voltage detecting circuit has a sample-and-hold circuit configured to sample said dc voltage within a time frame which is after a lapse of 1/30 a duration of a half polarity-changing cycle of said inverter from a start of said half polarity-changing cycle and is within /1;3 of said duration from said start.

10. A discharge lamp lighting apparatus according to claim 1, wherein said lamp power control circuit controls said ac power supplied to said discharge lamp by gradually increasing said lamp voltage from a predetermined initial voltage to a predetermined saturation voltage, a difference between said initial voltage and said saturation voltage being equal to or smaller than 50V.

11. A discharge lamp lighting apparatus according to claim 1, wherein said lamp power control circuit controls said ac power supplied to said discharge lamp by gradually increasing said lamp voltage from a predetermined initial voltage to a predetermined saturation voltage, a difference between said initial voltage and said saturation voltage being equal to or smaller than 40V.

12. A discharge lamp lighting apparatus according to claim 1, wherein said lamp power control circuit controls said ac power supplied to said discharge lamp by gradually increasing said lamp voltage from a predetermined initial voltage to a predetermined saturation voltage, a difference between said initial voltage and saturation voltage being equal to or smaller than 30V.

13. A discharge lamp lighting apparatus according to claim 1, wherein said lamp power control circuit controls said ac power supplied to aid discharge lamp by gradually increasing said lamp voltage from a predetermined initial voltage to a predetermined saturation voltage, a difference between said initial voltage and said saturation voltage being equal to or smaller than 20V.

14. A discharge lamp lighting apparatus comprising:

a high-voltage generating coil connected in series to a discharge lamp, the high voltage generating coil applying a high voltage to said discharge lamp to turn on said lamp;

an inverter inverting a direct current (DC) voltage into an alternating current (AC) voltage in order to supply a lamp current to said discharge lamp on an alternating basis through said high voltage generating coil;

a lamp voltage detecting circuit detecting a voltage across said discharge lamp as a lamp voltage; and a lamp power control circuit controlling an AC power applied to said discharge lamp from said inverter on the basis of said lamp voltage detected by said lamp voltage detecting circuit;

wherein:

said lamp voltage detecting circuit detects said lamp voltage by subtracting a voltage in proportion to a sum of voltage drops across devices other than said discharge lamp lying on a current path over which said lamp current flows from a voltage in proportion to said DC voltage, and said lamp voltage detecting circuit subtracts at least a voltage drop across said high voltage generating coil from said voltage in proportion to said DC voltage.

15. A discharge lamp lighting apparatus comprising:

a high-voltage generating coil connected in series to a discharge lamp, the high voltage generating coil applying a high voltage to said discharge lamp to turn on said lamp;

an inverter inverting a direct current (DC) voltage into an alternating current (AC) voltage in order to supply a lamp current to said discharge lamp on an alternating basis through said high voltage generating coil;

a lamp voltage detecting circuit detecting a voltage across said discharge lamp as a lamp voltage; and a lamp power control circuit controlling an AC power supplied to said discharge lamp from said inverter on the basis of said lamp voltage detected by said lamp voltage detecting circuit;

wherein:

said lamp voltage detecting circuit detects said lamp voltage by subtracting a voltage in proportion to a sum of voltage drops across devices other than said discharge lamp lying on a current path over which said lamp current flows from a voltage in proportion to said DC voltage, and said lamp voltage detecting circuit includes a first voltage detecting circuit for detecting a first sum of voltage drops across said devices and a voltage drop across said discharge lamp on the basis of said DC voltage, a second voltage detecting circuit for detecting a second sum of said voltage drops across said devices on the basis of said lamp current, and a subtraction circuit for subtracting said second sum from said first sum.

16. A discharge lamp lighting apparatus according to claim 15, wherein:

said inverter includes a semiconductor switch device, said first voltage detecting circuit detects the first sum of voltage drops across said devices including said semiconductor switch device within said inverter and a voltage drop across said discharge lamp on the basis of said DC voltage, said second voltage detecting circuit detects the second sum of voltage drops across said devices other than said semiconductor switch device on the basis of said lamp current, and said lamp voltage detecting circuit further includes a voltage generating circuit for generating a voltage equivalent to a voltage drop across semiconductor switch device, said subtraction circuit for subtracting said second sum and said voltage generated by said voltage generating circuit from said first sum.

17. A discharge lamp lighting apparatus according to claim 15, wherein:

said inverter includes a MOS transistor switching device, and said voltage generating circuit generates said voltage equivalent to said voltage drop across said MOS transistor switching device by dividing down a constant voltage by a predetermined dividing ratio.

18. A discharge lamp lighting apparatus according to claim 15, wherein said lamp voltage detecting circuit further includes a sample-and-hold circuit configured to sample said DC voltage within a time frame beginning after a lapse of 1/30 of a duration of a half polarity-changing cycle of said inverter from a start of said half polarity-changing cycle and ending within 1/3 of said duration.

19. A discharge lamp lighting apparatus according to claim 15, wherein said lamp power control circuit controls said AC power supplied to said discharge lamp by gradually increasing said lamp voltage from a predetermined initial voltage to a predetermined saturation voltage, a difference between said initial voltage and said saturation voltage being less than or equal to a predetermined voltage.

20. A discharge lamp lighting apparatus according to claim 15, wherein said inverter circuit includes a semiconductor switch device and wherein said lamp voltage detecting circuit subtracts at least a voltage drop across one of said high voltage generating coil and said semiconductor switch device from said voltage in proportion to said DC voltage.

* * * * *